US006690228B1

(12) United States Patent
Chen et al.

(10) Patent No.: US 6,690,228 B1
(45) Date of Patent: Feb. 10, 2004

(54) BANDGAP VOLTAGE REFERENCE INSENSITIVE TO VOLTAGE OFFSET

(75) Inventors: Jun Chen, Allen, TX (US); Siew Kuok Hoon, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/316,340

(22) Filed: Dec. 11, 2002

(51) Int. Cl.[7] ..... G05F 3/02

(52) U.S. Cl. ..... 327/538; 327/541; 327/542; 323/313

(58) Field of Search ..... 327/538, 539, 327/540, 541, 543, 307; 323/312–316

(56) References Cited

U.S. PATENT DOCUMENTS 4,263,519 A * 4/1981 Schade, Jr. ..... 327/539
5,132,556 A * 7/1992 Cheng ..... 327/539
5,825,167 A * 10/1998 Ryat ..... 323/312

* cited by examiner

*Primary Examiner*—Timothy P. Callahan
*Assistant Examiner*—An T. Luu
(74) *Attorney, Agent, or Firm*—J. Dennis Moore; W. James Brady, III; Frederick J. Telecky, Jr.

(57) ABSTRACT

A bandgap reference circuit. The circuit includes a first current mirror having a first mirror transistor and a second mirror transistor. A holding circuit has an output adapted to control a current though the first current mirror by operating to maintain substantially equal the voltages at a first input thereof and at a second input thereof. A first bipolar transistor having an emitter, a base, and a collector, wherein the area of the emitter thereof has a predetermined size, is arranged to conduct a collector current from the first mirror transistor. A second bipolar transistor having an emitter, a base, and a collector, wherein the area of the emitter thereof has a size that is proportional to the size of the emitter area of the first bipolar transistor, is arranged to conduct a collector current from the second mirror transistor, the base thereof being connected to the collector thereof. A first resistor is provided, in series with the collector of the second bipolar transistor and the second mirror transistor. The base of the first bipolar transistor is coupled to a common connection node of the first resistor and the second mirror transistor to substantially reduce the effects of offset error in the holding circuit. The holding circuit may be an operational amplifier.

6 Claims, 2 Drawing Sheets

BANDGAP VOLTAGE REFERENCE INSENSITIVE TO VOLTAGE OFFSET

TECHNICAL FIELD OF THE INVENTION

This invention relates to circuits that generate a reference voltage, and more particularly relates to bandgap voltage reference circuits.

BACKGROUND OF THE INVENTION

The band-gap voltage reference circuit is widely used in various low-voltage applications, in order to provide a stable voltage reference. The band-gap voltage reference circuit operates on the principle of compensating the negative temperature coefficient of a base-emitter junction voltage, $V_{BE}$, with the positive temperature coefficient of the thermal voltage $V_T$, with $V_T$ being equal to kT/q, where where k is the Boltzmann constant, T is absolute temperature, and q is electron charge ($1.6 \cdot 10^{-19}$ coulomb). The variation of $V_{BE}$ with temperature, at room temperature, is −2.2 mV/° C., while $V_T$ is +0.086 mV/° C. Note that since $V_T$ is Proportional To Absolute Temperature, it sometimes referred to using the acronym PTAT. Similarly, $V_{BE}$ is Complementary To Absolute Temperature, and so it is sometimes referred to using the acronym CTAT. The terms are combined to generate the band-gap voltage, $V_{BG}$:

$$V_{BG}=K_1V_{BE}+K_2V_T, \qquad \text{Eq. (1)}$$

where $K_1$ and $K_2$ are proportionality constants to ensure that the positive and negative thermal factors cancel one another, and, optionally, to scale the band-gap voltage to accommodate application requirements.

FIG. 1 is a circuit diagram showing a typical band-gap voltage reference circuit. The PMOS transistors M1, M2 and M3, bipolar transistors Q1 (having emitter area NA) and Q2 (having emitter area A), resistors R0, R1, R2 and R3 and operational amplifier (Op-amp) 101 are actual circuit elements. However, the voltage source 102 is merely representational, representing the offset voltage, $V_{OS}$, of Op-amp 101. Transistors Q1 and Q2 conduct substantially equal currents. Because the ratio of the emitter areas of transistors Q1 and Q2 is N, a $\Delta V_{BE}$, of substantially $V_T \cdot \ln(N)$, is produced across resistor R0, providing a PTAT current. The Op-amp 101 forces the voltages at nodes $V_1$ and $V_2$ to be equal, thereby causing currents to flow in resistors R1 and R2 which are proportional to $V_{BE}$, providing a CTAT current. The resulting current through transistors M1 and M2 is thus compensated in accordance with Equation (1). The compensated current is mirrored to transistor M3 to generate the output voltage $V_{OUT}$.

Specifically, in the circuit of FIG. 1, the output voltage, $V_{OUT}$, is:

$$V_{OUT} = \frac{R3}{R1} \cdot V_{BE2} + \frac{R3}{R0} \cdot V_T \cdot \ln(N) - \left(\frac{R3}{R1} + \frac{R3}{R0}\right) \cdot V_{OS}, \qquad \text{Eq. (2)}$$

where $V_{BE2}$ is the base-emitter voltage of transistor Q2 and N is the area ratio of transistors Q1 and Q2 (i.e., NA/A). Comparing Equation (2) with Equation (1), it is clear that the values of resistors R0, R1 and R3, and the emitter areas of transistors Q1 and Q2 are selected to provide the desired proportionality constants $K_1$ and $K_2$.

However, a problem with the circuit of FIG. 1 is that the Op-amp 101 typically has substantial $V_{OS}$, due, for example, to circuit asymmetries caused by device size mismatching.

This offset causes an error to be introduced into the output voltage, $V_{OUT}$, as can be seen in the last term in Equation (2). In addition, $V_{OS}$ is a temperature-dependent variable, due, for example, to $V_T$ mismatching of current mirrors and differential pairs within the Op-amp, so that this error varies with temperature. Note that Equation (2) shows that $V_{OS}$ is amplified by the factor $$\frac{R3}{R1} + \frac{R3}{R0}$$

in the generation of $V_{OUT}$. In typical circuits, R3 is much larger R0, in order to achieve proper cancellation of the PTAT and CTAT factors, and therefore the error in $V_{OUT}$ caused by $V_{OS}$ is also large. In bandgap voltage reference circuits not using an Op-amp, but including a configuration like that of M1, M2 and M3 in FIG. 1, an offset between voltages at nodes $V_1$ and $V_2$ can also occur.

Solutions have been proposed to reduce the error in band-gap voltage reference circuit output caused by such voltage offset. One such proposed solution is to trim the resistors. However, such solution is expensive, and is neither area efficient or pin efficient, since additional silicon area must be devoted to the extra resistance that is trimmed, and at least one pin must be used to perform the trimming which, in some applications, must be dedicated.

Another proposed solution, in circuits using an Op-amp, is to design a low-offset Op-amp incorporating large devices and carefully chosen topology. However, this proposed solution is difficult in low-power and low-voltage applications.

A still further proposed solution is to cascade two bipolar transistors. However, like the low-offset Op-amp proposed solution, this is also difficult in low-voltage applications. Yet another proposed solution is to use a chopping amplifier for the Op-amp. However, this adds considerable complexity to the circuit.

It would therefore be desirable to have a band-gap voltage reference circuit that compensates for voltage offset, while overcoming the problems of prior art proposed solutions.

SUMMARY OF THE INVENTION

The present invention provides a bandgap reference circuit. The circuit includes a first current mirror having a first mirror transistor and a second mirror transistor. A holding circuit has an output adapted to control a current though the first current mirror by operating to maintain substantially equal the voltages at a first input thereof and at a second input thereof. A first bipolar transistor having an emitter, a base, and a collector, wherein the area of the emitter thereof has a predetermined size, is arranged to conduct a collector current from the first mirror transistor. A second bipolar transistor having an emitter, a base, and a collector, wherein the area of the emitter thereof has a size that is proportional to the size of the emitter area of the first bipolar transistor, is arranged to conduct a collector current from the second mirror transistor, the base thereof being connected to the collector thereof. A first resistor is provided, in series with the collector of the second bipolar transistor and the second mirror transistor. The base of the first bipolar transistor is coupled to a common connection node of the first resistor and the second mirror transistor to substantially reduce the effects of offset error in the holding circuit. The holding circuit may be an operational amplifier.

These and other features of the invention will be apparent to those skilled in the art from the following detailed description of the invention, taken together with the accompanying drawings.

DETAILED DESCRIPTION OF THE PREFERRED EMBODIMENT

The numerous innovative teachings of the present invention will be described with particular reference to the presently preferred exemplary embodiments. However, it should be understood that this class of embodiments provides only a few examples of the many advantageous uses and innovative teachings herein. In general, statements made in the specification of the present application do not necessarily delimit the invention, as set forth in different aspects in the various claims appended hereto. Moreover, some statements may apply to some inventive aspects, but not to others.

Figure 2:
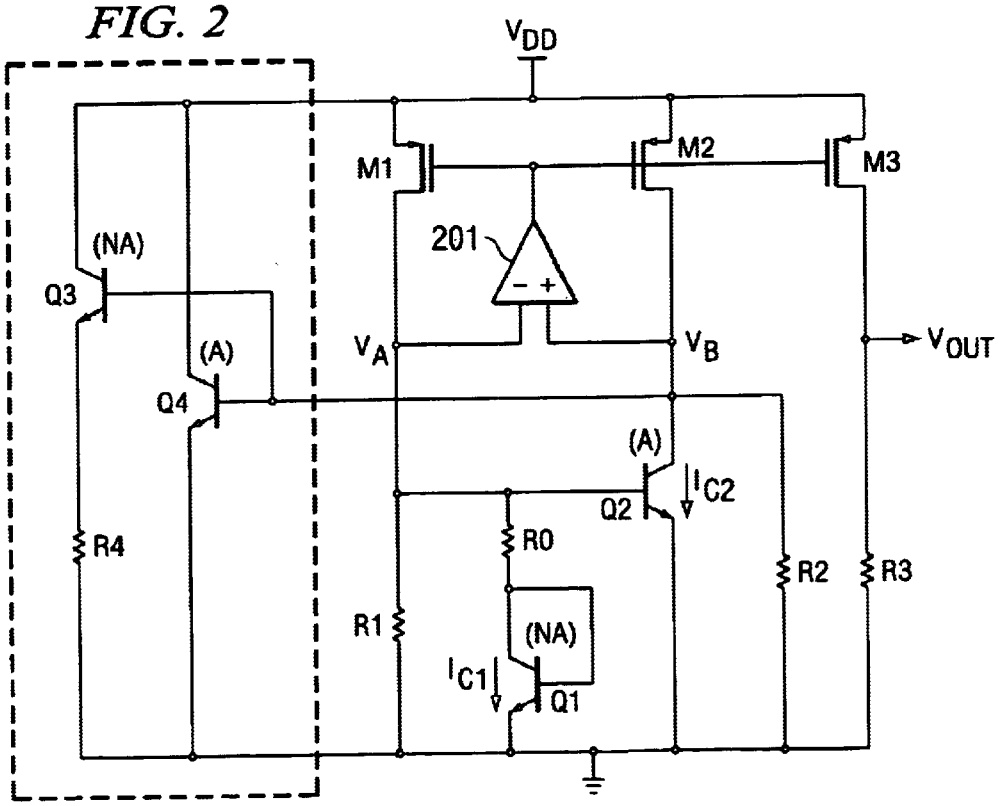
FIG. 2 is a circuit diagram of a band-gap voltage reference circuit in accordance with a first preferred embodiment of the present invention.

FIG. 2 is a circuit diagram of a band-gap voltage reference circuit implementing a preferred embodiment of the present invention. PMOS transistors M1, M2 and M3 are provided, each having their source connected to $V_{DD}$. The drain of transistor M1 is connected to ground through a resistor R1, the common connection node of drain of transistor M1 and resistor R1 being denominated node $V_A$. The drain of transistor M2 is connected to ground through resistor R2, the common connection node of drain of transistor M2 and resistor R2 being denominated node $V_B$. The drain of transistor M3 is connected to ground through resistor R3. The output of the circuit, $V_{OUT}$, is taken at the common connection node of transistor M3 and resistor R3. One terminal of a resistor R0 is also connected to the drain of transistor M1, with its other terminal being connected to collector of a bipolar transistor Q1, with the base of transistor Q1 being connected to its collector, and its emitter being connected to ground. The base of a bipolar transistor Q2 is connected to the common connection node of resistors R0 and R1, while its emitter is connected to ground and its collector is connected to the common connection node of transistor M2 and resistor R2. An Op-amp 201 has its inverting input connected to the common connection node of resistors R0 and R1 and the drain of transistor M1. The non-inverting input of Op-amp 201 is connected to the common connection node of transistor M2 and resistor R2. The output of Op-amp 201 is connected to the gates of transistors M1, M2 and M3. A third bipolar transistor Q3, having an area NA, has its collector connected to $V_{DD}$, its emitter connected to ground through a resistor R4, and its base connected to the base of a fourth bipolar transistor Q4. The collector of transistor Q4 is connected to $V_{DD}$, while its emitter is connected to ground. The base of transistor Q4 is also connected to the common connection node of transistor M2 and resistor R2. Note that a representative voltage source representing the offset voltage of Op-amp 201 is not shown in FIG. 2, but it is understood that such offset voltage is inherent in Op-amp 201.

Figure 1:
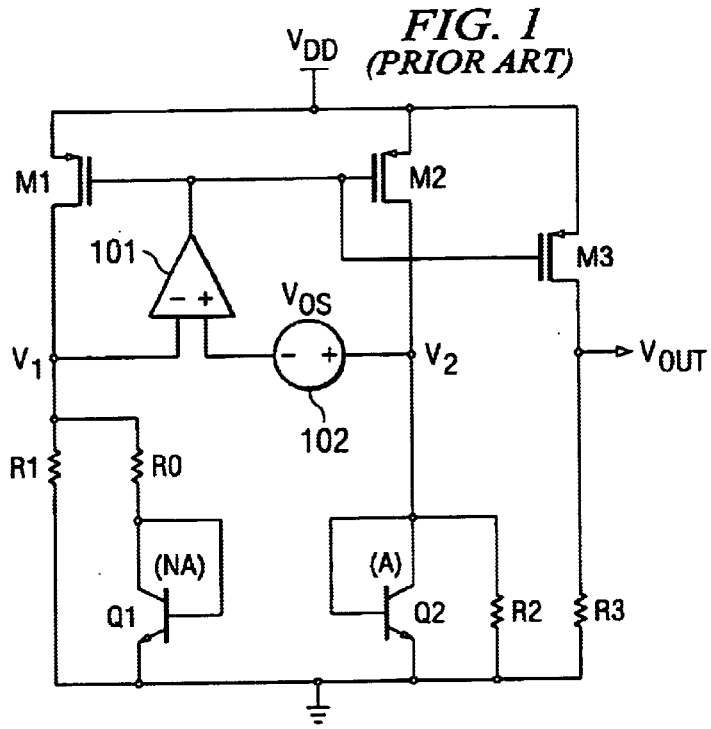
FIG. 1 (PRIOR ART)
FIG. 1 is a circuit diagram of a prior art band-gap voltage reference circuit.

Now, comparing the circuit of FIG. 2 with the circuit of FIG. 1, it can be seen that the base of bipolar transistor Q2 in FIG. 2 is not connected to its collector, as is the case with bipolar transistor Q2 in FIG. 1. Instead, the base of bipolar transistor Q2 is directly connected to node $V_A$. Further, transistors Q3 and Q4 and resistor R4 have been added. In general, by connecting the base of bipolar transistor Q2 directly to $V_A$ the error effect of any offset voltage $V_{OS}$ of Op-amp 201 in setting up the voltage across resistor R0, which generates the PTAT term, is substantially reduced, and even eliminated.

Since in the circuit of FIG. 2 the base-emitter current of transistor Q1, in series with resistor R0, and the base-emitter current of transistor Q2 are drawn from transistor M1, to provide balance in the circuit two additional base-emitter currents are drawn from transistor M2, by transistor Q3, in series with resistor R4, which is selected to have the same value as resistor R0, and transistor Q4. The collector voltage of transistor Q2 is clamped to $V_{BE2}$ by Op-Amp 201. Thus, transistor Q4 has the same base-emitter voltage and collector current as transistor Q2. The base current of transistor Q4 is drawn from the collector of transistor Q2, and is close to the base current of transistor Q2. The base current of transistor Q3 is also drawn from the collector of transistor Q2, and it is close to the base current of transistor Q1. These additional components are optional, but improve the performance of the circuit. If the base current of transistor Q1 is small, or if its β is very large (e.g., >100), omitting these additional components may be acceptable in a number of applications.

A residual error in $V_{OUT}$ from the $V_{OS}$ in Op-amp 201 remains in the circuit of FIG. 2, but it is quite small. This is discussed in detail below.

Specifically, in the circuit of FIG. 2, a $\Delta V_{BE}$ voltage is generated across resistor R0 to provide the PTAT current, $I_{PTAT}$:

$$I_{PTAT} = \frac{V_{BE2} - V_{BE1}}{R0}, \qquad \text{Eq. (3)}$$

where $V_{BE1}$ is the base-emitter voltage of transistor Q1, and other terms are as above.

Ignoring offset, the Op-amp 201 forces the voltages at nodes $V_A$ and $V_B$ to be substantially equal, thereby causing current to flow in resistor R1 (and in resistor R2) which is proportional to $V_{BE}$, providing the CTAT current, $I_{CTAT}$:

$$I_{CTAT} = \frac{V_{BE2}}{R1}. \qquad \text{Eq. (4)}$$

The current in the current mirror comprising transistors M1 and M2 is the sum of $I_{PTAT}$ and $I_{CTAT}$. In this way the bandgap voltage is provided.

However, Op-amp 201 will, in general, have an offset. The effects of this offset on the output of the circuit of FIG. 2 will now be described in detail. The effect of Op-amp 201 is to clamp the collector voltage of transistor Q2 to its base-emitter voltage, $V_{BE2}$, plus any offset voltage in Op-amp 201, i.e., to $V_{BE2}+V_{OS}$. The current flowing through resistor R2 is $$\frac{V_{BE2} + V_{OS}}{R2}.$$

Thus, the collector current $I_{c2}$ of transistor Q2 is:

$$I_{c2} = \frac{V_{BE2} - V_{BE1}}{R0} + \frac{V_{BE2}}{R1} - \frac{V_{BE2} + V_{OS}}{R2} = \frac{V_{BE2} - V_{BE1}}{R0} - \frac{V_{OS}}{R2}, \quad \text{Eq. (5)}$$

where R1=R2 is assumed. The collector current, $I_{c1}$ of transistor Q1 is:

$$I_{c1} = \frac{V_{BE2} - V_{BE1}}{R0}. \quad \text{Eq. (6)}$$

In addition, the output voltage, $V_{OUT}$, is:

$$V_{OUT} = \frac{R3}{R2} \cdot V_{BE2} + \frac{R3}{R0} \cdot (V_{BE2} - V_{BE1}). \quad \text{Eq. (7)}$$

Since the base-emitter voltage, $V_{BE}$, of a transistor is:

$$V_{BE} = V_T \cdot \ln \frac{I_c}{I_s}, \quad \text{Eq. (8)}$$

then:

$$\begin{aligned} V_{OUT} &= \frac{R3}{R1} \cdot V_{BE2} + \frac{R3}{R0} \cdot V_T \cdot \ln\left(N \cdot \frac{I_{c2}}{I_{c1}}\right) \\ &= \frac{R3}{R1} \cdot V_{BE2} + \frac{R3}{R0} \cdot V_T \cdot \ln(N) + \frac{R3}{R0} \cdot \\ &\quad V_T \cdot \ln\left(\frac{I_{c2}}{I_{c1}}\right). \end{aligned} \quad \text{Eq. (9)}$$

In Equation (9), the term $$\frac{R3}{R0} \cdot V_T \cdot \ln\left(\frac{I_{c2}}{I_{c1}}\right)$$

is $V_{error}$, the output voltage error introduced by the offset error of Op-amp 201, where $I_{c2}$ and $I_{c1}$ are given by Equations (5) and (6), respectively. Substitution of Equations (5) and (6) into the $V_{error}$ term gives:

$$V_{error} = \frac{R3}{R0} \cdot V_T \cdot \ln\left(\frac{I_{c2}}{I_{c1}}\right) = \frac{R3}{R0} \cdot V_T \cdot \ln\left(1 - \left(\frac{R0}{R2} \cdot \frac{V_{OS}}{\Delta V_{BE}}\right)\right) \quad \text{Eq. (10)}$$

Figure 3:
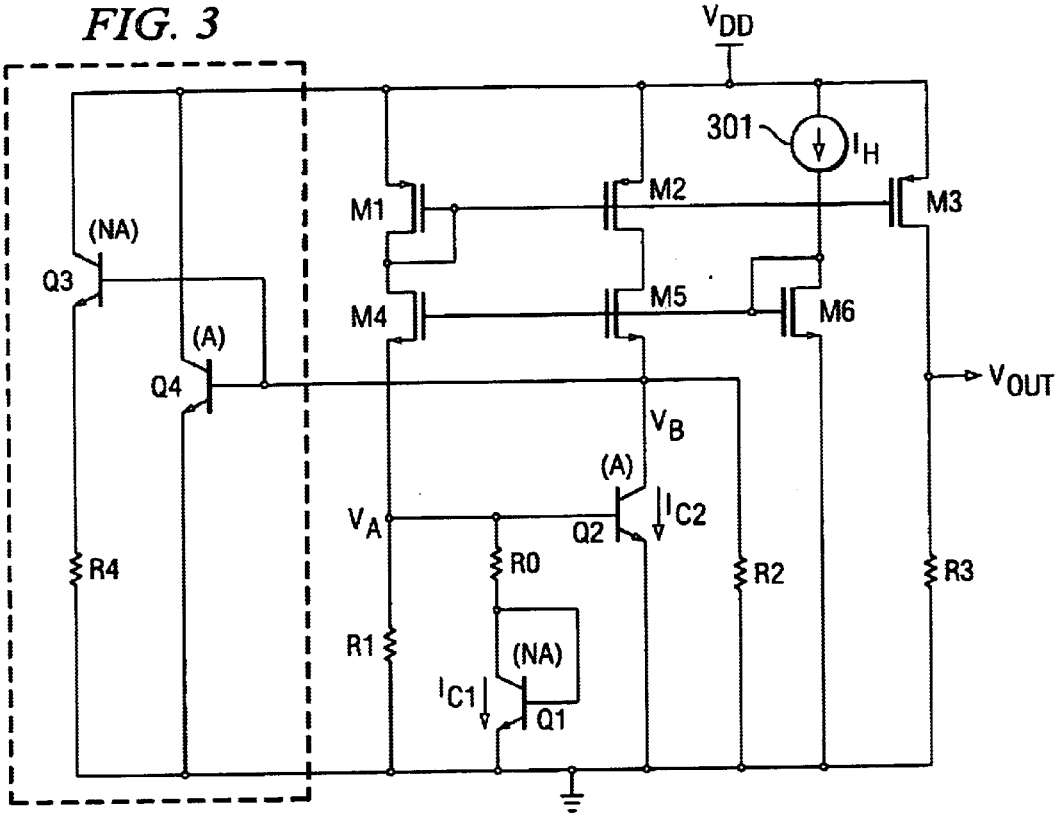
FIG. 3 is a circuit diagram of a band-gap voltage reference circuit in accordance with a second preferred embodiment of the present invention.

Note that in implementing the circuit of FIG. 3, typical values could be: R2=364 kΩ, R0=30.4 kΩ, $\Delta V_{BE} \approx 54$ mV, and $V_{OS} \approx 5$ mV. ($\Delta V_{BE}$ is substantially $V_T \cdot \ln(N)$.) Therefore, $V_{error}$ is shown to be negligible, i.e., approximately 1 mV at room temperature. Therefore, Equation (9) can be simplified to:

$$V_{OUT} = \frac{R3}{R1} \cdot V_{BE2} + \frac{R3}{R0} \cdot V_T \cdot \ln(N). \quad \text{Eq. (11)}$$

It has therefore been shown that the circuit of FIG. 2, which implements a preferred embodiment of the present invention, is much less sensitive to the offset voltage of its Op-amp than the circuit of FIG. 1.

Figure 4:
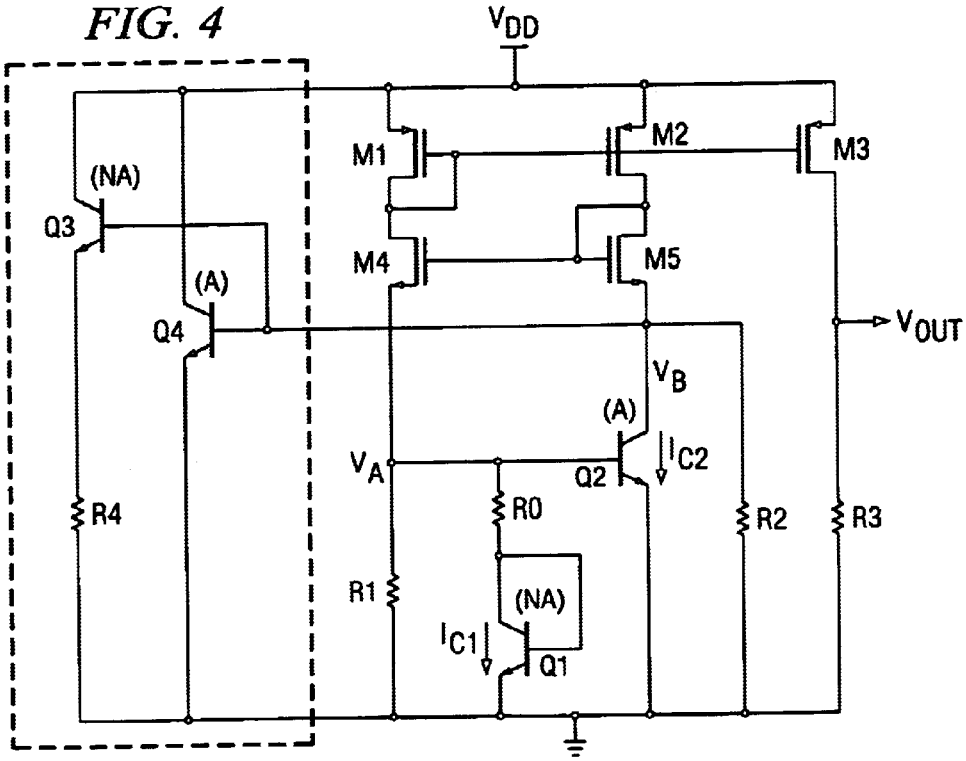
FIG. 4 is a circuit diagram of a band-gap voltage reference circuit in accordance with a third preferred embodiment of the present invention.

Although the present invention, its advantages and embodiments thereof have been described in detail, it should be understood that various changes, substitutions and alterations can be made herein without departing from the spirit and scope of the invention as defined by the appended claims. For example, some bandgap voltage reference circuits are similar to that shown in FIG. 1, but do not include a resistor R1 or R2. The principles of the present invention may still be applied to such arrangements, by connecting the base of bipolar transistor Q2 to node $V_A$, and the benefits of the invention realized in such circuits. In addition, in some embodiments circuits other than Op-amps may be used to hold the voltages at the sides of the current mirror at the same value. FIG. 3 shows such an arrangement, in which a current mirror comprising NMOS transistors M4, M5 and M6, and current source 301, hold the voltages at nodes $V_A$ and $V_B$ at the same value. The current $I_H$ sourced by current source 301 is selected to be substantially the same as current expected to flow through transistor M1 (or M2) in normal operation. Once again, the principles of the present invention may still be applied to such arrangements, by connecting the base of bipolar transistor Q2 to node $V_A$, and the benefits of the invention realized in such circuits. FIG. 4 shows a still further variation, in which the voltages at nodes $V_A$ and $V_B$ are held at substantially the same value by NMOS transistors M4 and M5 configured as shown. Again, the principles of the present invention may still be applied to such arrangements, by connecting the base of bipolar transistor Q2 to node $V_A$, and the benefits of the invention realized in such circuits. Further, note that rather than providing a voltage output, the compensated current that is generated can be mirrored to a transistor or other circuit element, and the mirrored current provided as an output current. Other variations are possible. All such circuits are within the scope of the invention as set forth and claimed herein.

What is claimed is:

1. A bandgap reference circuit, comprising:

a first current mirror comprising a first mirror transistor and a second mirror transistor;

a holding circuit having an output adapted to control a current though the first current mirror by operating to maintain substantially equal the voltages at a first input thereof and at a second input thereof;

a first bipolar transistor having an emitter, a base, and a collector, wherein the area of the emitter thereof has a predetermined size, arranged to conduct a collector current from the first mirror transistor;

a second bipolar transistor having an emitter, a base, and a collector, wherein the area of the emitter thereof has a size that is proportional to the size of the emitter area of the first bipolar transistor, arranged to conduct a collector current from the second mirror transistor, the base thereof being connected to the collector thereof;

a first resistor in series with the collector of the second bipolar transistor and the second mirror transistor;

wherein the base of the first bipolar transistor is coupled to a common connection node of the first resistor and the second mirror transistor.

2. A bandgap reference circuit according to claim 1, wherein the holding circuit comprises an operational amplifier.

3. A bandgap reference circuit according to claim 1, further comprising:

a second resistor in parallel with the first resistor and the collector of the second bipolar transistor; and a third resistor in parallel with the emitter and the collector of the first bipolar transistor.

4. A bandgap reference circuit according to claim 1, further comprising:

a second resistor;

a third bipolar transistor arranged to conduct a base-emitter current and having a base coupled to the first mirror transistor; and a fourth bipolar transistor arranged to conduct a base-emitter current through the second resistor and having a base coupled to the first mirror transistor.

5. A bandgap reference circuit according to claim 1, wherein the holding circuit comprises a second current mirror, comprising:

a third mirror transistor adapted to conduct a mirror current substantially the same as the current through the second mirror transistor;

a fourth mirror transistor coupled to the third mirror transistor to mirror the mirror current therethrough, and coupled between the first mirror transistor and the first bipolar transistor; and a fifth mirror transistor coupled to the third mirror transistor to mirror the mirror current therethrough, and coupled between the second mirror transistor and the second bipolar transistor.

6. A bandgap reference circuit according to claim 1, wherein the holding circuit comprises a second current mirror coupled between the first current mirror and the first and second bipolar transistors, and adapted to mirror a current substantially the same as the current through the second mirror transistor thorough the first mirror transistor.

* * * * *